US006692593B2

(12) United States Patent
Neubauer

(10) Patent No.: US 6,692,593 B2
(45) Date of Patent: Feb. 17, 2004

(54) METHOD FOR QUENCHING METALLIC WORKPIECES

(75) Inventor: Uwe Neubauer, Leinburg (DE)

(73) Assignee: Linde Aktiengesellschaft, Wiesbaden (DE)

( * ) Notice: Subject to any disclaimer, the term of this patent is extended or adjusted under 35 U.S.C. 154(b) by 168 days.

(21) Appl. No.: 10/076,072

(22) Filed: Feb. 15, 2002

(65) Prior Publication Data

US 2002/0121320 A1 Sep. 5, 2002

(30) Foreign Application Priority Data

Feb. 20, 2001 (DE) ..... 101 08 057

(51) Int. Cl.[7] ..... C22F 1/02; C21D 1/56; C21B 7/10

(52) U.S. Cl. ..... 148/712; 266/46

(58) Field of Search ..... 148/708, 709, 148/712; 266/46

(56) References Cited

U.S. PATENT DOCUMENTS 4,867,808 A * 9/1989 Heilmann et al. ..... 148/633

FOREIGN PATENT DOCUMENTS

| | | | |
|---|---|---|---|
| EP | 0495151 A1 | * | 7/1992 |
| JP | 58-147514 | * | 9/1983 |
| WO | WO 89/12111 | * | 12/1989 |

* cited by examiner

*Primary Examiner*—John J. Zimmerman
(74) *Attorney, Agent, or Firm*—Crowell & Moring LLP

(57) ABSTRACT

A method for quenching metallic workpieces in a furnace space, includes subjecting a metallic workpiece to a heat treatment process in an evacuated furnace space. Before a quenching gas or mixture is passed into the furnace space, hydrogen is supplied to the still evacuated furnace space. The amount of hydrogen supplied to the furnace space is limited so that, depending on (1) the quenching pressure, (2) the gas temperature at the end of the quenching process, and (3) the composition of the quenching gas or mixture, a hydrogen concentration below the explosive limit is reached in the quenching gas or mixture. The quenching gas or mixture contains an inert gas or a mixture of inert gases, such as nitrogen, argon and/or helium.

9 Claims, No Drawings

METHOD FOR QUENCHING METALLIC WORKPIECES

This application claims the priority of German application No. 101 08 057.3, filed Feb. 20, 2001, the disclosure of which is expressly incorporated by reference herein.

BACKGROUND AND SUMMARY OF INVENTION

The present invention relates to a method for quenching metallic workpieces in a furnace space, especially at above-atmospheric pressure. An inert gas or a mixture of inert gases, especially nitrogen, argon and/or helium are a used as quenching gas (mixture), after the metallic workpiece has been subjected to a heat treatment process in an evacuated furnace space.

Generic methods for quenching metallic workpieces are known. At high temperatures, especially at temperatures above 700° C., metals react very sensitively to oxygen. For example, at 1000° C., chromium is oxidized already at an oxygen partial pressure of about $10^{-23}$ bar. Moreover, higher contents of, for example, titanium, result in an undesired formation of nitride, because of which heat treatment cracks can occur.

For a large number of quenching processes, a forming gas is used, which consists of about 5% hydrogen and about 95% nitrogen. By this forming gas, a slight surface oxidation is achieved on the metallic material that is to be treated and, moreover, the work is carried out below the explosive limit.

It is an object of the present invention to create a method for quenching metallic workpieces, for which annealing colors and oxidation phenomena at the surfaces of metallic workpieces can be reduced or avoided. Moreover, the absorption of nitrogen, as well as the nitride formation mentioned, are to be reduced.

DETAILED DESCRIPTION OF INVENTION

According to the present invention, a method for quenching metallic workpieces is proposed, wherein, before the quenching gas (mixture) is passed into the furnace space, hydrogen is supplied to the still evacuated furnace space. The amount of hydrogen supplied to the furnace space is limited so that, depending on the quenching pressure, the gas temperature at the end of the quenching process, and the composition of the quenching gas (mixture), a hydrogen concentration below the explosive limit is reached in the quenching gas (mixture).

Pursuant to the present invention, hydrogen is supplied to the still evacuated furnace space after the heat treatment process and before the quenching gas (mixture) is passed into the furnace space. The amount of hydrogen, which is to be supplied to the furnace space, depends, however, on the quenching pressure, the gas temperature at the end of the quenching process, and the composition of the quenching gas (mixture).

In an advantageous manner, the inventive method for quenching metallic workpieces is carried out so that the hydrogen concentration in the quenching gas (mixture) does not exceed 5%.

The following advantages are achieved by the addition of hydrogen to the still evacuated furnace space before the addition of the quenching gas (mixture): (1) the formation of annealing colors and oxidation phenomena at the surface of the metallic workpieces is decreased or avoided; (2) the absorption of nitrogen and the formation of nitride because of the slight temperature decrease, associated with the addition of hydrogen, are decreased; and (3) cleaner surfaces are formed, so that less finishing work is required.

As a further development of the inventive method for quenching metallic workpieces, it is proposed that the pressure, existing in the furnace space, be measured or determined before the hydrogen is added to the still evacuated furnace space.

This embodiment ensures an oxygen-free furnace space, so that an undesirable and, under some circumstances, dangerous mixing of oxygen and hydrogen is effectively prevented.

Advantageously, the hydrogen is added to the still evacuated furnace space as quickly as possible or suddenly. For this purpose, the hydrogen is expanded into the furnace space from a storage tank or buffer container, which preferably is connected directly to the furnace space.

Such storage tanks or buffer containers usually are filled at a defined pressure, so that the introduction of the hydrogen into the furnace space or the amount of hydrogen, which is to be passed into the furnace space, can be controlled.

Moreover, the quenching gas (mixture) is also advantageously added as quickly as possible or suddenly to the furnace space, for example, also through expansion from a storage tank or buffer container.

At the end of the quenching process, the furnace space advantageously is flushed with an inert gas (mixture). Additionally or alternatively, the quenching gas (mixture), leaving the furnace space, is burned off so that it is emitted to the atmosphere in a controlled manner.

After the step or steps, named above, the pressure in the furnace space can be relieved and the furnace space opened for removal of the metallic workpiece or workpieces.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for quenching metallic workpieces in a furnace space, comprising:

subjecting a metallic workpiece to a heat treatment process in an evacuated furnace space;

supplying an amount of hydrogen to the evacuated furnace space before a quenching gas or a quenching gas mixture is passed into the furnace space; and subsequently passing the quenching gas or quenching gas mixture comprising an inert gas or a mixture of inert gases into the furnace space, thereby quenching the metallic workpiece, wherein the amount of hydrogen supplied is limited so that, depending on a quenching pressure, a gas temperature at the end of the quenching, and a composition of the quenching gas or the quenching gas mixture, a hydrogen concentration below the explosive limit is obtained in the quenching gas or quenching gas mixture.

2. A method for quenching metallic workpieces according to claim 1, wherein the inert gas is at least one of nitrogen, argon, and helium.

3. A method for quenching metallic workpieces according to claim 1, wherein the quenching is above atmospheric pressure.

4. A method for quenching metallic workpieces according to claim 1, wherein the hydrogen concentration in the quenching gas or quenching gas mixture does not exceed 5%.

5. A method for quenching metallic workpieces according to claim 1, further comprising measuring a pressure, existing in the furnace space, before supplying the hydrogen to the evacuated furnace space.

6. A method for quenching metallic workpieces according to claim 1, wherein the hydrogen is supplied by expansion from a storage tank or buffer container.

7. A method for quenching metallic workpieces according to claim 1, wherein the quenching gas or quenching gas mixture is added to the furnace space by expansion from a storage tank or buffer container.

8. A method for quenching metallic workpieces according to claim 1, further comprising, after quenching, flushing the furnace space with an inert gas or inert gas mixture.

9. A method for quenching metallic workpieces according to claim 1, further comprising, after quenching, burning off the quenching gas or quenching gas mixture emerging from the furnace space.

* * * * *